US008464976B2

(12) United States Patent
Mok et al.

(10) Patent No.: US 8,464,976 B2
(45) Date of Patent: Jun. 18, 2013

(54) DISPENSER LOADING ARRANGEMENT AND METHOD OF LOADING A DISPENSER

(75) Inventors: Kin Lun Mok, Hong Kong (CN); King Lun Mok, Hong Kong (CN); Hong Ng, Hong Kong (CN)

(73) Assignee: SCA Hygiene Products AB, Gothenburg (SE)

( * ) Notice: Subject to any disclaimer, the term of this patent is extended or adjusted under 35 U.S.C. 154(b) by 1302 days.

(21) Appl. No.: 12/097,660

(22) PCT Filed: Dec. 14, 2005

(86) PCT No.: PCT/EP2005/013450
§ 371 (c)(1),
(2), (4) Date: Sep. 23, 2008

(87) PCT Pub. No.: WO2007/068271
PCT Pub. Date: Jun. 21, 2007

(65) Prior Publication Data
US 2011/0168831 A1 Jul. 14, 2011

(51) Int. Cl.
*B65H 20/02* (2006.01)

(52) U.S. Cl.
USPC ..... 242/564.4; 242/565; 242/580

(58) Field of Classification Search
USPC ..... 242/579, 580, 564, 564.1, 564.2, 242/564.3, 564.4, 565, 598.5, 598.6
See application file for complete search history.

(56) References Cited

U.S. PATENT DOCUMENTS

| | | | | |
|---|---|---|---|---|
| 3,730,409 | A * | 5/1973 | Ratti | 225/10 |
| 5,375,785 | A | 12/1994 | Boone et al. | |
| 5,526,973 | A | 6/1996 | Boone et al. | |
| 5,772,291 | A | 6/1998 | Byrd et al. | |
| 5,924,617 | A * | 7/1999 | LaCount et al. | 242/564.4 |
| 5,979,821 | A * | 11/1999 | LaCount et al. | 242/564.4 |
| 6,250,530 | B1 * | 6/2001 | LaCount et al. | 225/10 |
| 6,710,606 | B2 | 3/2004 | Morris | |
| 6,736,348 | B1 | 5/2004 | Formon et al. | |
| 6,830,210 | B2 | 12/2004 | Formon et al. | |
| 6,871,815 | B2 | 3/2005 | Moody et al. | |
| 6,902,134 | B2 * | 6/2005 | Green et al. | 242/598.6 |
| 6,903,654 | B2 | 6/2005 | Hansen et al. | |
| 6,988,689 | B2 | 1/2006 | Thomas et al. | |
| 7,017,856 | B2 | 3/2006 | Moody et al. | |
| 7,114,677 | B2 | 10/2006 | Formon et al. | |
| 7,182,289 | B2 | 2/2007 | Moody et al. | |
| 7,185,841 | B2 * | 3/2007 | Kaufmann | 242/564.4 |

(Continued)

FOREIGN PATENT DOCUMENTS

| | | |
|---|---|---|
| EP | 0 880 331 | 10/2004 |
| EP | 1 716 800 | 11/2006 |

(Continued)

*Primary Examiner* — William A Rivera
(74) *Attorney, Agent, or Firm* — Buchanan Ingersoll & Rooney PC

(57) ABSTRACT

A dispenser for sheet material such as paper towel, having a housing body and a housing cover. A feed mechanism in the dispenser includes a drive roller and a pressure roller forming a nip therebetween. Movement of the housing cover from a closed position towards an open position moves the pressure roller relatively away from the drive roller to open the nip. The reverse occurs during closing the cover. This allows easy access to the space between the rollers when adding a new supply of sheet material or when removing sheet material jams. A method for loading a dispenser is also included.

20 Claims, 6 Drawing Sheets

U.S. PATENT DOCUMENTS

| | | | |
|---|---|---|---|
| 7,191,977 | B2 | 3/2007 | Denen et al. |
| 7,237,744 | B2 | 7/2007 | Morris et al. |
| 7,296,765 | B2 | 11/2007 | Rodrian |
| 7,341,170 | B2 | 3/2008 | Boone |
| 7,387,274 | B2 | 6/2008 | Moody et al. |
| 2003/0019971 | A1 | 1/2003 | Lewis et al. |
| 2005/0171634 | A1 | 8/2005 | York et al. |
| 2006/0006275 | A1 | 1/2006 | Neveu et al. |
| 2006/0173576 | A1 | 8/2006 | Goerg et al. |
| 2007/0080255 | A1 | 4/2007 | Witt et al. |
| 2007/0152010 | A1 | 7/2007 | Denen et al. |
| 2007/0158359 | A1 | 7/2007 | Rodrian |
| 2007/0194166 | A1 | 8/2007 | Reinsel et al. |
| 2008/0011772 | A1 | 1/2008 | Morris et al. |
| 2008/0018302 | A1 | 1/2008 | Reinsel et al. |
| 2008/0078777 | A1 | 4/2008 | Cittadino et al. |
| 2008/0087758 | A1 | 4/2008 | Formon et al. |
| 2008/0099595 | A1 | 5/2008 | Lewis et al. |

FOREIGN PATENT DOCUMENTS

| | | |
|---|---|---|
| WO | WO 98/53728 | 12/1998 |
| WO | 02/00083 | 1/2002 |
| WO | 2005/065509 | 7/2005 |
| WO | 2006/060047 | 6/2006 |
| WO | 2006/065515 | 6/2006 |
| WO | 2007/098419 | 8/2007 |
| WO | 2008/011460 | 1/2008 |
| WO | 2008/042382 | 4/2008 |
| WO | 2008/042962 | 4/2008 |
| WO | 2008/042964 | 4/2008 |
| WO | 2008/053383 | 5/2008 |

* cited by examiner

DISPENSER LOADING ARRANGEMENT AND METHOD OF LOADING A DISPENSER

FIELD OF THE INVENTION

The present invention relates to a dispenser, in particular to a dispenser comprising a housing body, a housing cover and a feed mechanism, said feed mechanism comprising a drive roller and a pressure roller, wherein said drive roller and said pressure roller form a nip therebetween and wherein said housing cover is movable with respect to said housing body for opening and closing said housing cover. The invention also relates to a method of loading a dispenser of this type.

The dispenser of the invention and the type which is to be loaded according to the method, is for feeding sheet material supplied preferably in the form of a generally cylindrical sheet material supply roll, wherein the sheet material is stored in a rolled configuration. Other forms of supply are however possible. Dispensers of the invention are preferably automatic dispensers incorporating a motor-driven feed mechanism (i.e. dispensing system) combined with control circuitry for same. Suitably, the activation of the motor driven feed mechanism may be as a result of a user-sensing system being employed, which system can be a touchless user-detection system (e.g. an infrared sensor system, a light sensor system, or a capacitative sensor system, etc., as known per se in the art, which do not require physical contact of a user). The system may however instead, or additionally, be operable to dispense sheet material upon touching a sensor or switch. Likewise the dispenser of the invention may have instead, or additionally, a mode of operation in which towels are dispensed when a towel has been removed by a user (this mode of operation often being referred to as a "hanging-towel" mode).

Such automatic dispensers of the invention may be provided with a whole range of different sensors, e.g. for paper quantity on a supply roll or other supply, paper presence at one or more locations, paper jams, etc.

Automatic dispensers of the invention are also preferably of the electrically powered type, preferably by means of one or more batteries (but which could also be AC powered or powered by a combination of AC and DC power supplies).

The perforated, or preferably non-perforated, rolls of paper or other sheet material which may be used in the dispensers of the invention are dispensed over a period of time. In the case of towel dispensers for which the invention is particularly appropriate, the dispensers are typically monitored by attendant staff, for example to check whether they have become jammed or have to be refilled. The dispensers may thus be provided with one or more indicators indicating, e.g. visually and/or audibly indicating, the need to refill the machine with a new towel roll. The indicators may be mechanically-moving devices (e.g. mechanical follower devices) indicating low paper, or automatic devices (e.g. electronically controlled devices) indicating that paper is low by means of sensors, or that paper has been used up. A variety of other indicators may also be present.

BACKGROUND TO THE INVENTION

A dispenser of the type mentioned in the opening paragraph is known from e.g. US2003/0168550-A1.

This document discloses a feed mechanism comprising a pressure roller and a drive roller, whereby the drive roller is driven by means of a motor by way of a worm drive. When a paper jam occurs, the user may open the dispenser cover and press a release means in order to remove the worm drive from engagement with the drive roller, whereby jammed paper can be removed through the nip between the drive roller and pressure roller without needing to overcome the force of the motor. This can be done by rotating the drive roller or the pressure roller to move paper in the nip. Likewise, the dispenser is provided with a loading structure (for loading a further roll within the dispenser) having a type of cradle into which a leading edge portion of a paper sheet can be introduced to be pressed with the aid of fingers on a bar into the nip between the rollers, while at the same time causing the drive roller to rotate such that the leading edge of the sheet is drawn through the nip when the cover is closed.

The aforementioned systems are relatively complicated, the first requiring the user to initially open the dispenser, then to activate the release retaining means to free the motor from the drive roller, and then rotate one or both rolls, and the second requiring a large system of interacting elements. Further disadvantages of the dispenser system are also apparent.

The object of the invention is to provide a simple and easily operable system in a dispenser allowing loading of a leading edge of sheet material into the nip between a drive roller and a pressure roller, and likewise allowing jams to be removed easily if they should occur. Similarly, the object of the method of the invention is to allow simple, easy and reliable loading of a supply of material into a dispenser and likewise allowing jams to be removed easily if they should occur.

Further objects of the invention will be apparent upon reading this specification.

SUMMARY OF THE INVENTION

The main object of the invention is achieved by a dispensing device having a housing body (3), a housing cover (2) and a feed mechanism, the feed mechanism including a drive roller (8) and a pressure roller (9), where the drive roller (8) and the pressure roller (9) form a nip therebetween and where the housing cover (2) is movable with respect to the housing body (3) for opening and closing the housing cover (2), and where the housing cover (2) is operably connected to the pressure roller (9) and/or the drive roller (8) such that movement of said housing cover (2) from a closed position towards an open position moves the pressure roller (9) relatively away from the drive roller (8) to thereby open the nip.

Further features of the invention will be apparent to the reader of this specification.

Any locations on the dispenser are defined with respect to the dispenser in its normal position of use and not mounted upside down or the like. Thus, the lower part of the dispenser is intended to be at the bottom when mounted. Likewise the lateral direction of the dispenser is intended to mean a generally horizontal direction.

BRIEF DESCRIPTION OF THE DRAWINGS

The invention will now be explained in more detail with reference to certain non-limiting embodiments thereof and with the aid of the accompanying drawings, in which.

DETAILED DESCRIPTION OF PREFERRED EMBODIMENTS

Figure 1:
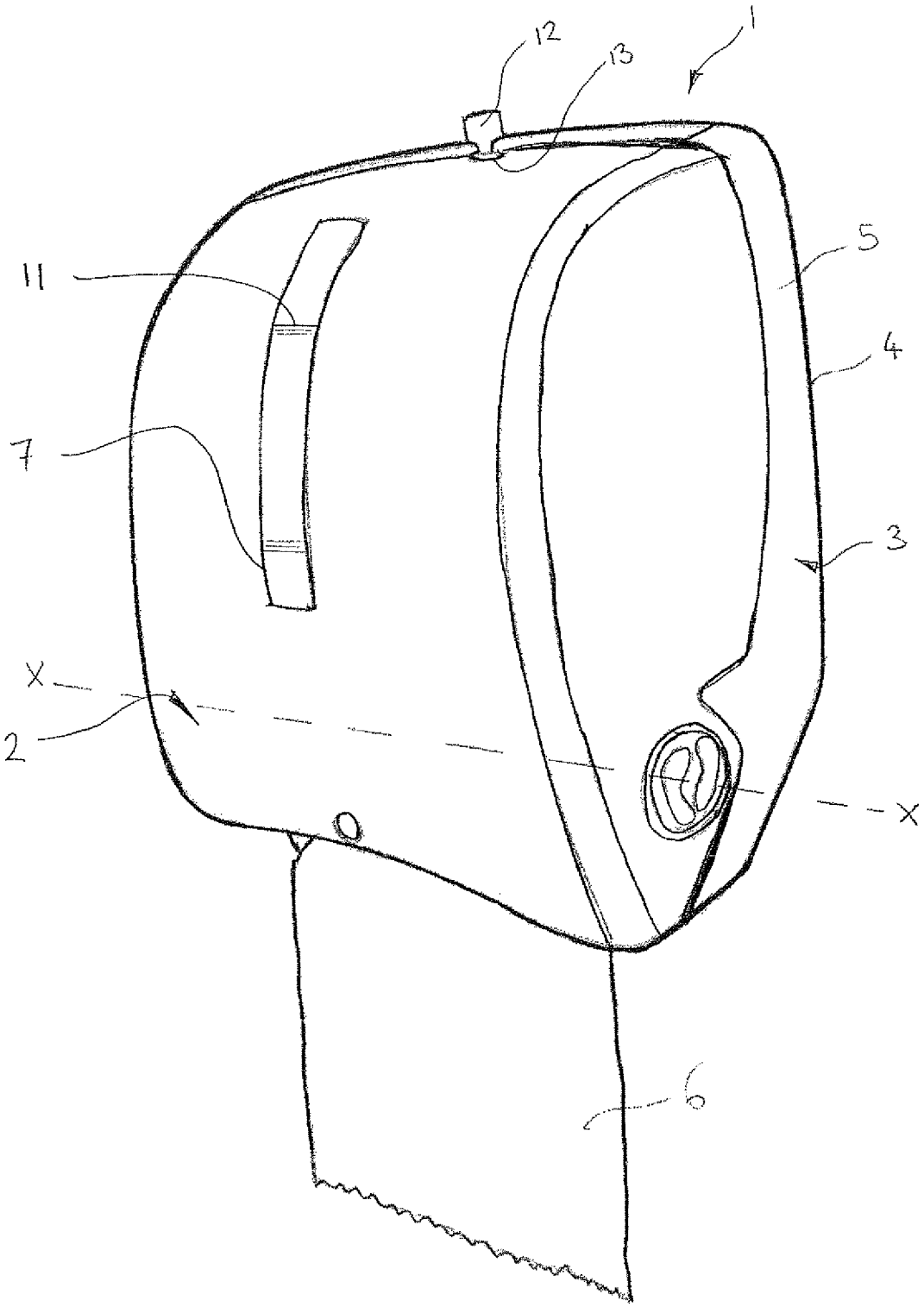
FIG. 1 shows a simplified schematic view of one embodiment of a dispenser housing from a front side view with its rear side generally vertical.

FIG. 1 shows a dispenser 1, including a housing comprising a housing body 3 and a housing cover 2, said housing body preferably including a rear wall 4 and one or more side walls 5. The housing cover 2 can preferably be pivoted about a pivot axis X-X. The cover 2 can further be latched in place with respect to the housing body 3 by means of a latch mechanism 13 which be locked by a key 12.

A piece of sheet material 6, e.g. paper, such as paper toweling, is shown in a towel hanging position, waiting to be removed by a user. In the position shown, the material 6 has thus already been dispensed through an outlet (not shown) at the lower side of the dispenser by a feed mechanism (to be explained further below). The towel, for example, can be removed by a user by holding the towel and drawing the towel across a tear means such as a cutting blade edge or the like, so as to tear/cut the material 6 away from the remainder of a supply of towel material in the dispenser, as is well known per se in the art.

Figure 3:
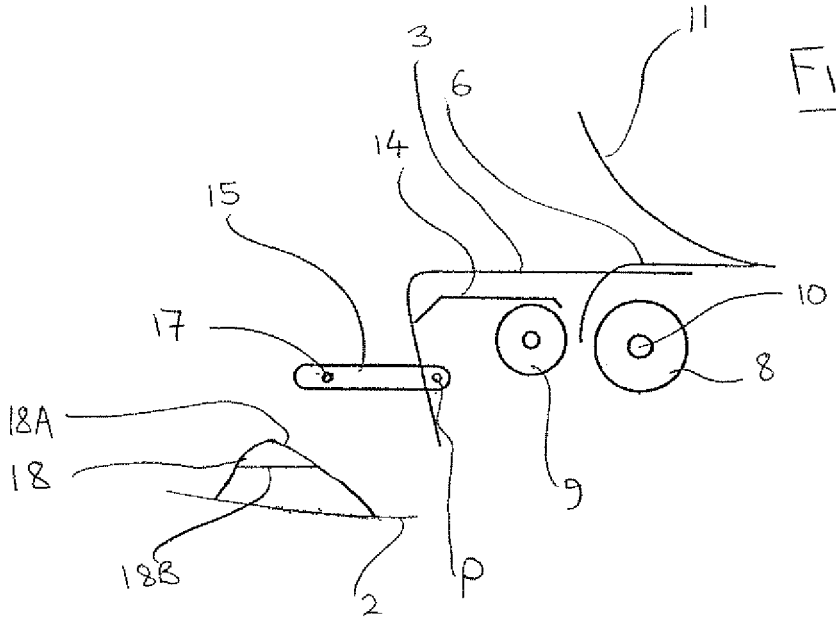
FIG. 3 shows a schematic view of the arrangement in FIG. 2 depicting possible relative positions of the drive roller, pressure roller, pressure roller carrier and movement arrangement for same when said housing cover is fully open.
Figure 4:
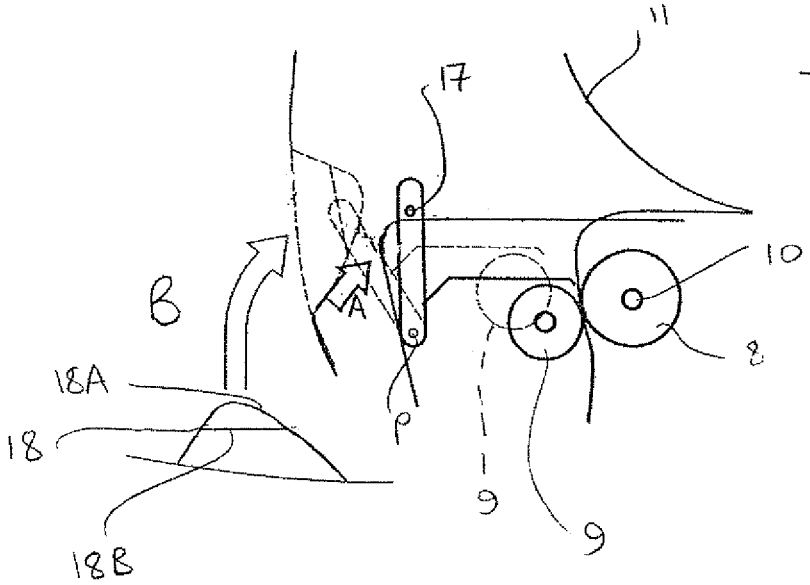
FIG. 4 shows a view similar to FIG. 3 whereby the cover projection is moved from the open position in FIG. 3 to an intermediate position and to a closed position.

The housing cover 2 may also include a window portion 7 through which the sheet material (e.g. paper towel in the form of a supply roll 11—shown in part in FIGS. 3 and 4) can be viewed to give a visual indication of the presence of sheet material 6.

The dispenser 1 is normally intended to be attached to a stationary object (e.g. a wall) in the orientation shown in the drawing, whereby the rear wall 4 is preferably mounted so as to be generally vertical and whereby a supply roll of sheet material 6 is preferably mounted generally horizontally.

A feed mechanism comprising a drive roller 8 (see FIG. 2) and a pressure roller 9, is arranged to dispense the sheet material 6. In the orientation shown in FIG. 1, the drive roller 8 and the pressure roller 9 are preferably located below said supply roll 11 and also generally parallel thereto. Other orientations and other locations are however possible, such as vertical orientations of each of the rollers 8 and 9.

The sheet material supply has the sheet material 6 wound typically in the form of a spirally wound roll 11, having a generally cylindrical configuration. The roll 11 may include a core portion (not shown) of e.g. cardboard or plastics. The sheet material may be any suitable flexible material, typically paper (for hand towels, toilet towels, kitchen towels etc.,) but it may also be cloth-like or may be a plastic film. Such sheet material will be substantially non-elastic, although elastic materials may also be used.

The sheet material 6 is suitably a roll 11 of continuous non-perforated sheet material 6 such as non-perforated paper material, but may also comprise perforated sheet material such as perforated paper sheet material. The material may also be stored in the form of interleaved sheets (e.g. concertina folded paper sheets).

The drive roller 8 is preferably substantially cylindrical, possibly having one or several roller portions (three portions are shown in FIG. 1) and is provided with e.g. a steel shaft 10 on which said portion(s) are attached or integrally moulded. The drive roller 8 surfaces are suitably made of rubber material or another material able to reliably feed the sheet material 6 when rotated whilst nipping the sheet material 6 between the outer surface of drive roller 8 and a pressure roller 9 mounted preferably parallel to and in pressure contact with drive roller 8. Such an arrangement of drive roller and pressure roller to perform sheet feeding are well known per se for applications of driving sheet material through the nip formed therebetween upon rotation of drive roller 8 against pressure roller 9.

The pressure roller 9 in the shown embodiment comprises a single outer surface, but may also be formed with several portions similar to drive roller 8. More or less portions can be used, but preferably these match the number of portions on the drive roller 8. Pressure roller 9 may be formed of plastics material, but may be advantageously formed of metal whereby static charges formed by friction can be largely conducted away through said roller 9.

Drive roller 8 is driven by means of a motor, e.g. a battery driven motor. The motor and the drive roller are preferably in constant engagement, e.g. by means of reduction gearing on the motor output shaft and the end of shaft 10 respectively. Other forms of drive systems may also be used. Suitable batteries may supply a total of 6V when new, and typically four 1.5V batteries are suitable for this purpose.

The drive roller 8 is supported in the housing by means of supports for rotation with respect to the housing upon activation of the motor. In one embodiment, the drive roller 8, motor and pressure roller 9 may form elements of a modular cassette which can be removed as a modular unit from the dispenser housing if required. In this case, the mountings for the shaft 10 and the pressure roller shaft would then preferably both be in the modular cassette housing. As will be explained in more detail below, the pressure roller 9 and/or the drive roller 8 of the invention must be movable towards/away from one another in order that the nip formed therebetween can be opened when required.

When the motor is activated this causes drive roller 8 to rotate and to thus draw sheet material 6 from a supply roll 11 (visible partially through window 7) through the nip of pressure roller 9 and drive roller 8. In turn, this causes the supply roll 11 to rotate, causing sheet material 6 to be unwound from the supply roll 11.

The supply roll 11 is rotatably mounted in the dispenser housing, on supports provided in the housing body 3 (this is also the case where a modular cassette is used as described above, since the supply roll 11 is not included in a modular cassette).

The motor will be at rest when no sheet material 6 is to be dispensed. The motor is rotated when material 6 is to be dispensed through the dispensing outlet. The operation of the motor may be controlled by a master control unit including a microprocessor (not shown). The motor operation may be controlled either in terms of rotational time or measuring actual rotation or dispensed sheet material length, to dispense a predetermined length of sheet material, which is preferably an adjustable predetermined length (e.g. suitably between 10 cm and 50 cm).

The control system may further be connected to, or part of, a user-sensing system comprising one or more sensors. The one or more sensors may for example be IR emitters and one or more sensors may be IR receivers (e.g. diode structures) forming part of an active IR detection system. Other user detection systems are possible, including manually operated ones (e.g. by touching a sensor or switch, or passive IR, capacitative etc.). Furthermore, the invention can operate of course without such a user detection system, whereby a fresh piece of sheet material 6 is dispensed automatically when a previous piece of sheet material 6 has been removed (which can be detected by a pressure bar, or paper sensor of another type), to be left hanging for grasping by a user (i.e. "hanging towel" mode).

Figure 2:
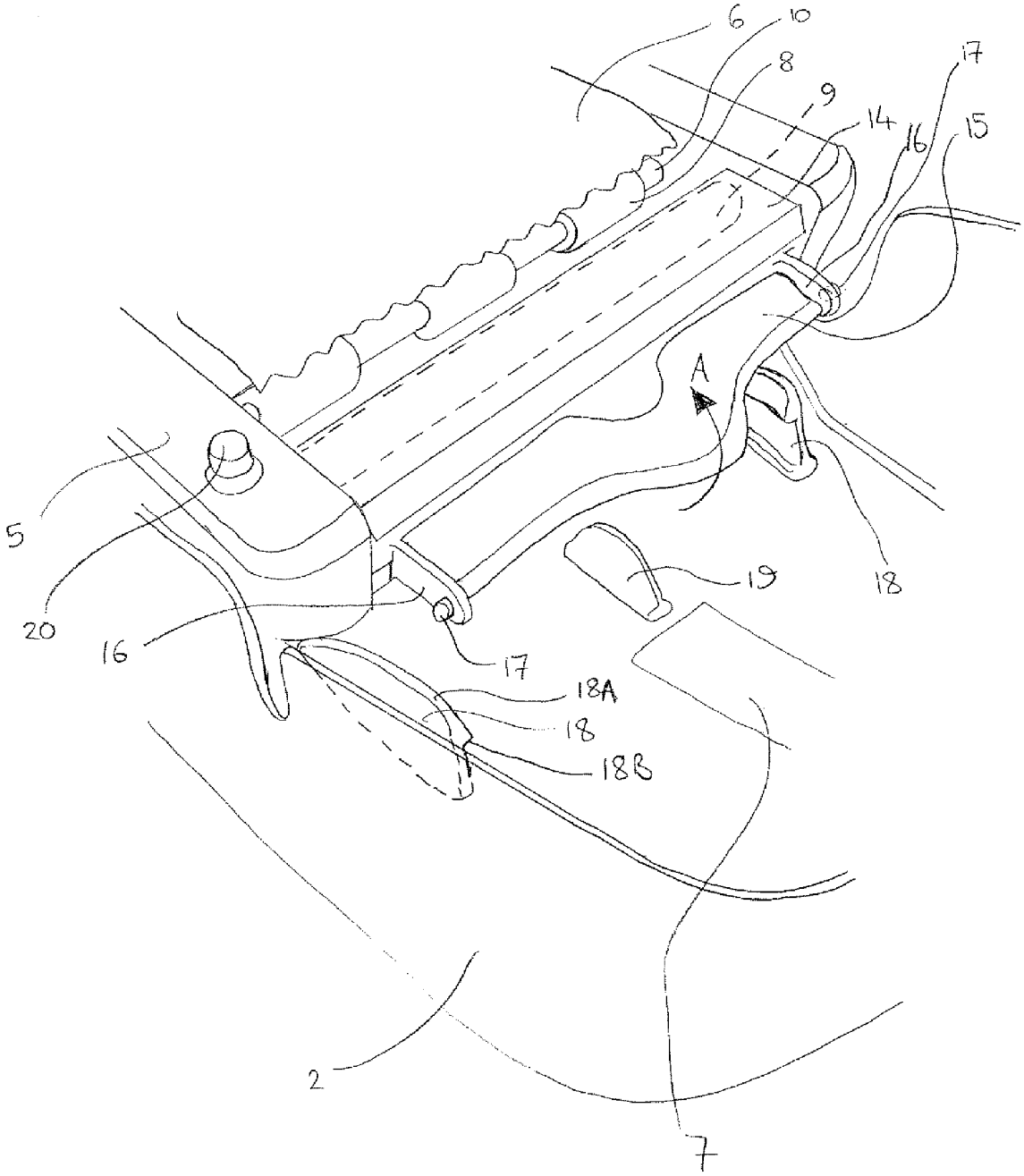
FIG. 2 shows a schematic view of the dispenser of FIG. 1 turned however (for reasons of clarity) such that the dispenser is laying on its back and with the housing cover open, revealing a movement arrangement for said pressure roller.

The drive mechanism shown in FIG. 2 is shown in a position where the nip is open, i.e. the roller 9 has been moved out of contact with the drive roller 8. The pressure roller 9 may be rotatably supported within a movable member such as a movable carrier 14. The pressure roller may also be movably supported in a guide. In the embodiment shown, the carrier 14 and pressure roller 9 are movable together as a unit between the sides 5 of the housing body 3. It will be understood that carrier 14 may be differently constructed. In the embodiment shown, carrier 14 may be acted upon by an arm 15 which extends across at least partially the width of the dispenser and is fixedly attached to, or formed with, two end portions 16. Each end portion 16 has fixedly located thereon, but possibly rotatably located thereon, at least one further surface, here in the form of a projection 17 which projects laterally outward of the end portion 16 of said arm 15. Each projection 17 acts as a guide follower for slidable engagement with a guide member 18 projecting inwardly from said housing cover 2 towards the interior of said dispenser housing, said guide member 18 including therein or thereon at least one guide surface 18A, said guide surface 18A being slidably movable against the projection 17, when the cover 2 is pivoted from its position shown in FIG. 2 towards a closed position. Movement of cover 2 towards the closed position initially causes no movement of projection 17 since the guide surface 18A is separated from the projection 17 when in the fully open position. When the cover has moved through about 20° to 50°, for example, towards its closed position, the surface 18A contacts the projection 17 (this occurring at both ends when there is a projection 17 at each end of arm 15). Further movement of the cover 2 towards the closed position causes arm 15 to rotate in the direction of arrow A towards the carrier 14 and finally to cause it to move in a direction towards drive roller 8. A further projection 19 attached to the cover 2 and projecting inwardly therefrom may also be provided to act on arm 15 proximate the lateral centre thereof.

As arm 15 is swung in the direction of arrow A it moves carrier 14 and pressure roller 9 therewith towards drive roller 8. Continued movement towards the closed position of the cover 2 causes pressure between drive roller 8 and pressure roller 9. The pressure roller 9 may be resiliently biased towards drive roller 8. In this way further movement of pressure roller 9 towards drive roller 8 when these two are already in contact causes said resilient means to compress and the force between the rollers to increase.

The guide surface 18A may be formed such that after swinging the arm 15 into an upright position the guide surface moves past projection 17, such that surface 18B is located behind projection 17, while surface 19 continues to apply pressure to arm 15.

When in the closed position, an internal surface of cover 2, or a projection formed thereon, contacts e.g. switch or sensor 20 which causes a single activation of the drive motor so as to drive the drive roller 8 in the direction of dispensing sheet material 6 through the dispensing outlet. In this way a predetermined length of sheet material (e.g. between 5 and 30 cm) can be dispensed when closing the cover 2. This acts as a check function for an attendant, showing that the dispenser is working correctly and that paper is correctly being dispensed.

Upon opening the cover 2 again, for example when wishing to replace a product supply roll or remove a jam, the surface 18B may be used to pull against projection 17, thus causing the arm to move downwardly and to pull the carrier 14 with it, thereby opening the nip. Further movement of the cover 2 towards a fully open position will then release the guide surface 18B from contact with projection 17, thus allowing cover 2 to be opened further without acting on projection 17. The mounting of carrier 14 with respect to the dispenser housing 3 is preferably arranged such that when the guide surface 18B releases from projection 17, the carrier 14 will have reached a stable end position, such that the carrier 14 will not move back to a position where the pressure roller 9 contacts the drive roller 8 until the cover is again moved towards a closed position.

In the above way, it is understood that opening and closing of the cover 2 causes opening and closing of the nip between the pressure roller 9 and the drive roller 8. It will be evident for a skilled person that various other or additional guide surface arrangement, or other movement arrangements, including lost motion arrangements in which some part of the movement of one member causes no movement of another member, can be used to accomplish the desired effect of opening and closing the nip upon opening the cover 2.

In the open position of the nip, a previously jammed piece of sheet material 6 can be simply removed from between the rollers 8 and 9, and a fresh piece of material 6 can be drawn between the rollers 8 and 9 for re-operation of the dispenser when the cover is closed again. Likewise when refilling the machine with a new supply of sheet material 6 e.g. on a supply roll 11, a leading edge portion the sheet material from the supply roll is simply drawn between the two rollers and then the cover 2 is closed, clamping the sheet material 6 in the nip, ready for operation. The switch or sensor 20 as mentioned above, if present, will thus cause a predetermined amount of sheet material to be dispensed. If no sheet material 6 is dispensed, it will be evident that either the sheet material 6 was inserted incorrectly, or another fault has occurred.

The arrangement shown in FIG. 3 corresponds generally to the situation shown in FIG. 2, whereby cover 2 is open and the guide surfaces 18B and 18A are separated from the projection 17, since the cover has been moved towards a fully open position, whereby before reaching this position the surface 18A has pivoted the projection 17 downwardly together with arm 15 around pivot P.

The arrangement in FIG. 4 corresponds to that in FIG. 3, but shows the arm 15 being guided upwardly by surface 18A in an intermediate position where arm 15 is moving in direction of arrow A, this intermediate position being shown in dashed lines and which has been reached by movement of projection 18 from the lowest position in the direction of arrow B, towards the final position shown in solid lines, whereby the pressure roller 9 and drive roller 8 clamp the sheet material 6 between the nip formed therebetween. The intermediate and final position of the pressure roller 9 may be as shown, whereby the pressure roller 9 moves downwards when moving into engagement with drive roller 8. It will however be apparent that other end positions can be reached depending on the exact details of the moving structures, all of which are included within the invention.

As mentioned previously, the actual details of the movement mechanism can be varied within the scope of the invention, such that opening of the cover 2, at least during part of its movement, causes movement of the pressure roller 9 (and/or the drive roller 8) so that the nip between pressure roller 9 and drive roller 8 is opened, and vice versa whereby closure of the cover causes said pressure roller 9 and drive roller 8 to move together. Movement of the pressure roller 9 avoids the need for movement of the drive roller 8 together with drive motor and thus a light and simply operated arrangement is achieved. However, it will be evident that the same effect of opening the nip may be achieved by arranging the drive roller 9 to move instead of the pressure roller, or by arranging both rollers 8, 9 to move away from each other.

Figure 5:
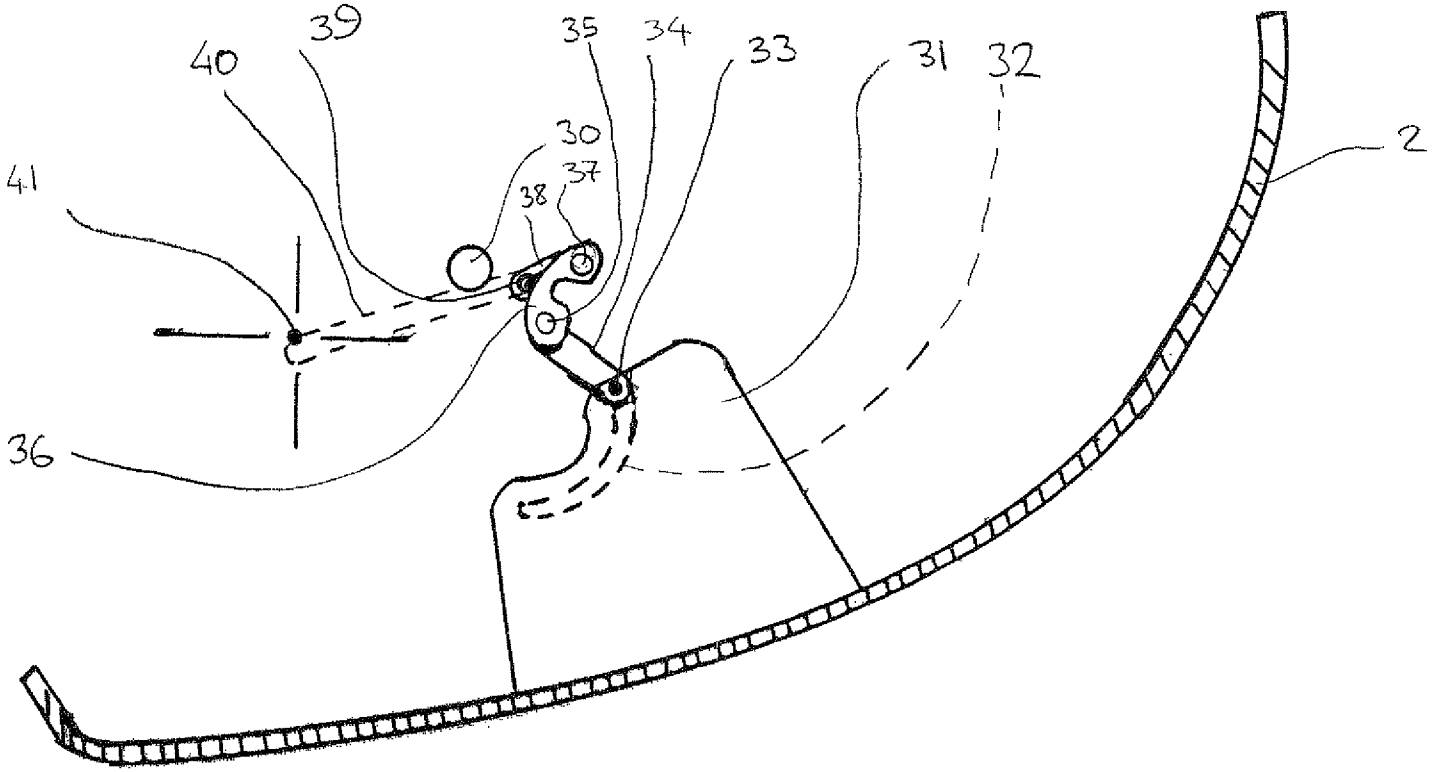
FIG. 5 shows a view of an alternative form of a pressure roller movement arrangement in a first position.
Figure 6:
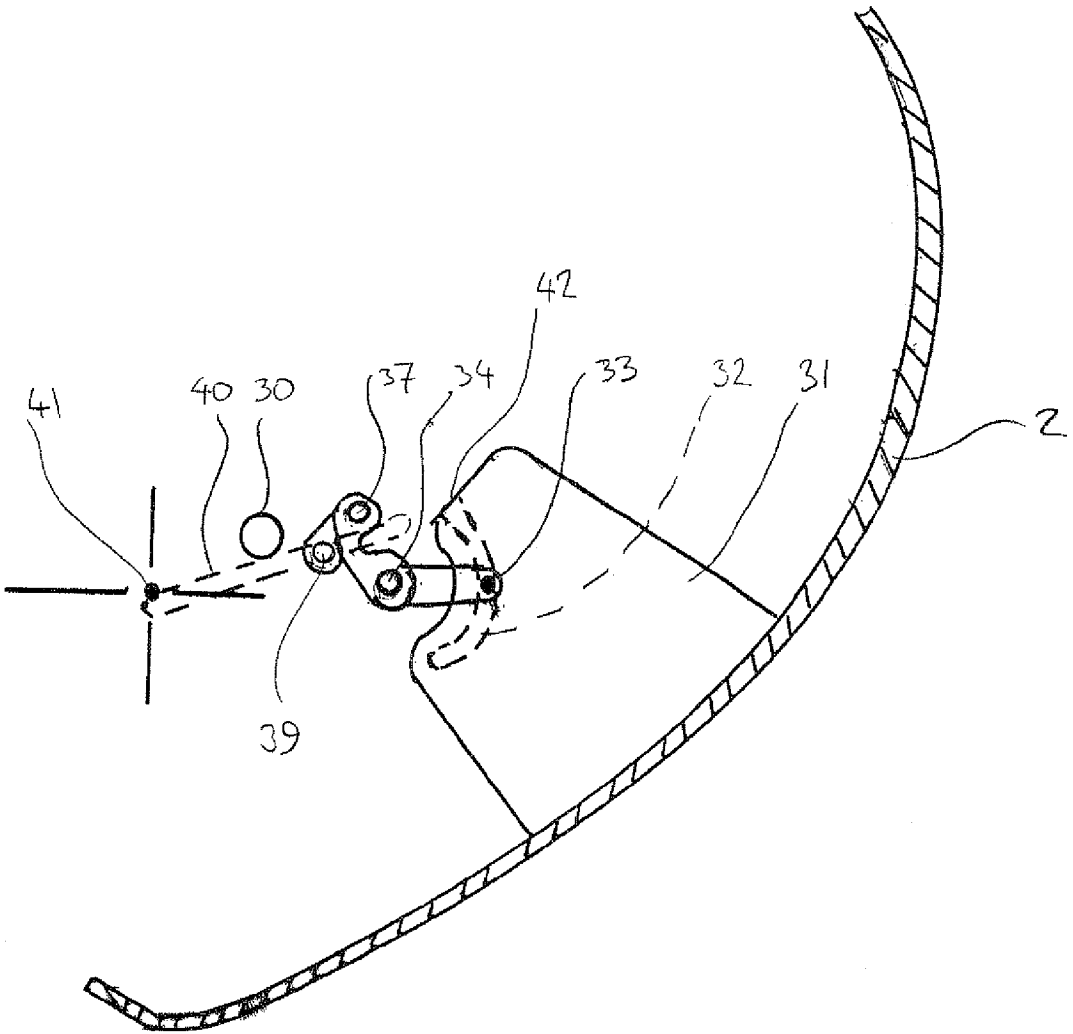
FIG. 6 shows the arrangement of FIG. 5 in a second position.
Figure 7:
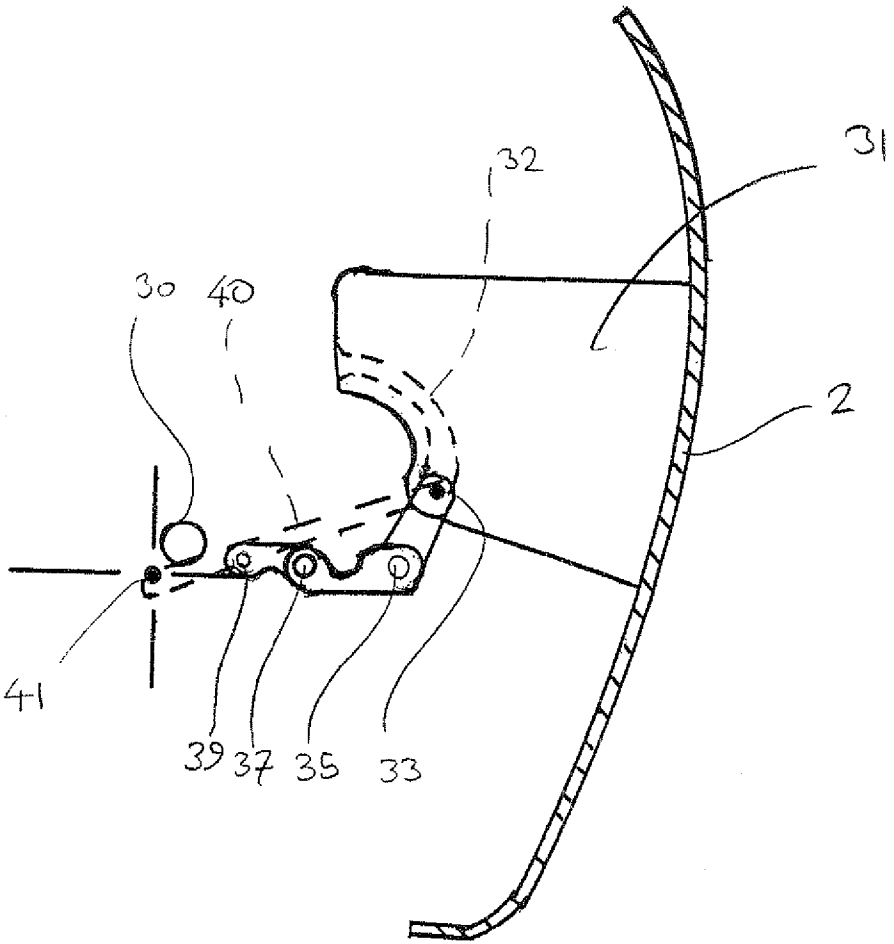
FIG. 7 shows the arrangement of FIG. 5 in a third position.

A further embodiment of the invention is shown in FIGS. 5 to 7, in which successive movement of the cover 2 from a first open position to a third closed position are shown. FIG. 5 shows a first open position of the cover 2, in which the shaft 30, forming the axis of pressure roller 9, is in a first position and in which the nip formed between drive roller 8 and pressure roller 9 is fully open.

A projection 31 formed on, or attached to, the inside of cover 2 projects inwardly from an internal surface of the cover. The projection 31, which may be in the form of a flat web, may be made e.g. of hard plastics, typically of the same material as cover 2 and preferably formed as part of an integral moulding of cover 2. Either within projection 31 or on one flat side thereof, is a guide surface 32 in the form of a curved slot or groove. Within this slot or groove, a slidable element 33 is received for movement along the guide surface 32 when cover 2 is opened and closed. A first arm 34 of a linkage is attached to element 33, whereby the element 33 can be e.g. fixedly or rotatably attached to arm 34. A further arm 36 is included which is pivotally attached to arm 34 at pivot 35. At its other end, arm 36 has a further pivot 37 fixedly or rotatably attached to arm 38. Arm 38 in turn has a projection 39 which slides within a guide slot 40. Guide slot 40 is arranged within a fixed portion of the dispenser, suitably the housing body 3, or any other holding means for the drive roller 8 (e.g. a modular cassette).

Although the various arms of the linkage are shown with differing forms, it will be apparent that the form can be varied within large limits. Likewise while a three-arm linkage is shown, a different number of arms (e.g. more or less than three) can be used in the linkage, depending on the dispenser arrangement.

Reference 41 indicates a suitable pivot point of the cover 2 for the linkage shown.

The attachment of shaft 30 to another member has not been shown, but the centre of this shaft is arranged at a fixed distance to the centre of projection 39. Projection 39 may thus be suitably attached to shaft 30 or to a carrier for shaft 30.

In the position shown in FIG. 6, the cover has been swung anticlockwise from the FIG. 5 position abut pivot point 41, whereby element 33 has moved to a somewhat central position in the guide slot 32 and projection 39 has moved further down slot 40. The shaft 30 has also moved with the movement of projection 39, thus closer to the pivot point 41 of the cover 2 (and therefore closer to the drive roller 9).

AS shown in FIG. 7, the cover 2 has reached its fully closed position, whereby projection 33 has arrived at the end of slot 32 and the shaft 30 has reached its final point of travel, at which location the pressure roller 9 will be in full pressure contact with drive roller 8 (i.e. a closed nip location).

It should be noted that cover 2 can also be moved further open than depicted (i.e. the right hand end of cover can be moved further clockwise than the position shown in FIG. 5) if desired, in which case projection 33 may be removed from guide surface 32, for example by being pulled through the widened exit 42 of a slot at the end face of the projection 31 (see FIG. 6). The end of the guide surface 32 may be provided with an openable latch mechanism temporarily preventing this removal through exit 42 if desired. In such a case, the linkage 34 may be arranged to maintain (e.g. by suitable blocking means) its position as shown in FIG. 5 even with the cover opened further, such that, upon swinging the cover from this further opened position, the exit 42 (which may be provided with chamfered or another type of lead-in surface), can again slidably engage the projection 33 and be moved again to the closed position with the movements between FIGS. 5 to 7 as explained above.

Due to the fixed distance that is maintained between shaft 30 and projection 39, when the cover 2 is moved from the closed position shown in FIG. 7 clockwise to the position shown in FIG. 6 and FIG. 5, the shaft moves upwards away from the pivot point 41 and thereby also opens the nip again to the fully opened position of the nip which is represented by the pressure roller shaft 10 having reached the position shown in FIG. 5.

In the fully opened position of the nip (e.g. FIG. 3 or FIG. 7), the pressure roller 9 should be sufficiently distant from the drive roller 8 such that easy access to the nip for inserting a leading edge of sheet material 6 is obtained. Preferably such a distance is at least 0.5 cm, but more preferably 1 cm or more, irrespective of the type of operable connection which is used to connect the cover to drive roller 8 and/or pressure roller 9.

The switch or sensor 20 is in communication with a control system (not shown), which activates the dispenser in one of the manners described previously. In this regard, the switch or sensor 20 may suitably be arranged such that opening of the cover immediately turns off power to the motor driving the drive roller. In this way, there is no danger for someone filling the dispenser or removing a jam for example, that the drive roller 9 can be caused to rotate causing possible injury (e.g. if the presence of a user were detected which would normally cause sheet material, to be dispensed).

Nevertheless, switch or sensor 20 can also be arranged to be manually actuated if desired by a person to allow inspection of other parts of the feed mechanism when the housing cover 2 is open.

While a single linkage is shown in FIGS. 5 to 7, one linkage at each lateral side of the cover 2 may be provided, in a similar way to the two guide members 18 in the first embodiment, such that there would be two projections 31 extending inwardly from the cover 2.

The end of any such linkage will be connected at one end to the cover (e.g. by the sliding connection as shown) and at the other end may be connected to the pressure roller 9 or the shaft 30 thereof directly, or there may be an intermediate member such as a carrier which supports the pressure roller 9. Such a carrier may be formed for example merely by the housing(s) in which the pressure roller rotates, or a further member connected to or supporting said bearing housings. It is also possible to arrange such a linkage to act on a point on the roller shaft 30 not at its ends, but e.g. in the middle thereof, in the case of a split pressure roller 9.

One or more of the projections 33, 35, 37, 39 at the pivot locations may be in the form of a projecting lug.

The invention also concerns a method of loading a dispenser 1 comprising a housing body 3, an openable and closable housing cover 2, and a feed mechanism comprising a drive roller 8 and a pressure roller 9, forming a nip between the rollers 8, 9. Loading includes both loading of a fresh supply of sheet material 6 when a previously supply has become depleted or partially depleted, and also includes the loading of sheet material into the feed mechanism when a jam has occurred and the sheet material has been removed from the feed mechanism.

When a jam occurs or when the dispenser needs refilling with a new supply, the housing cover 2 is opened. This allows access to a user either for removing a piece of sheet material originally jammed in the rollers to be removed, or alternatively or additionally to insert a supply of sheet material (typically in the form of a roll or other form as described previously) into a storage location for said sheet material within the dispenser. A previous roll core may need to be removed first before inserting a new supply, if a roll with a physical central core (e.g. hollow cylindrical cardboard or plastic tube) has been used. Typically the storage location may be simply support mountings for a roll of sheet material about which a roll of sheet material may rotate when a leading edge thereof is pulled for example. The support mountings may also be differently formed of course. In order to insert a leading edge portion of sheet material into the correct location for allowing the feed mechanism to dispense the sheet material, a leading edge portion of the sheet material 6 is inserted between the rollers 8, 9 in an open condition of said nip (which can for example be opened in a way that has been described previously), in which open condition the drive roller 8 and said pressure roller 9 have been moved relatively away from each other by a distance equal to at least twice the thickness of said sheet material 6. A distance of far larger than this is however preferable, e.g. 0.5 cm or greater, as has been described previously. This allows a large opening between the rollers 8, 9 for inserting a leading edge portion into the open nip. Importantly there is no requirement whatsoever to rotate either the drive roller or the pressure roller, since the leading edge has lots of room to fit in this space. Indeed it is preferred if no movement of either drive roller occurs as this is safer for a user when the cover 2 is open.

Either prior to, or conjointly with closing the cover 2 as described in terms of the operative connection of the cover and the drive and/or feed roller as described previously, the nip is closed so as to clamp sheet material 6 in the nip. Upon closing the cover 2, the drive roller 8 may also be caused to rotate (e.g. by automatic means such as a switch or sensor 20 as described previously) thereby causing sheet material to be dispensed by the feeding mechanism. No such rotation is however required and thus switch or sensor 20 could be removed if desired.

In the above way it is evident that a sheet material jam, e.g. a paper jam, can be easily and quickly removed and/or that a fresh supply, or even a part-used supply if desired, of sheet material 6 can be inserted into the feed mechanism of the dispenser 1 and made ready for use, without requiring rotation of either of the feed mechanism rollers 8, 9. When ready for use, the closing of the cover for example can be used to dispense an initial portion of sheet material 6 as described previously.

One or more of the features of the various embodiments of the dispenser described in the aforegoing, either individually or in combination, may be used in a dispenser to which the method is applied.

Many further forms of the invention can be contemplated without departing from the scope of the invention defined in the claims.

The invention claimed is:

1. A dispenser, comprising:

a housing body;

a housing cover; and a feed mechanism comprising a drive roller and a pressure roller, wherein said drive roller and said pressure roller form a nip therebetween, said housing cover is movable with respect to said housing body for opening and closing said housing cover, said housing cover is operably connected to at least one of said pressure roller or said drive roller such that movement of said housing cover from a closed position towards an open position moves said pressure roller relatively away from said drive roller to thereby open said nip, said housing cover is operably connected to said pressure roller by at least one rotatable linkage, said linkage is connected at one end to said housing cover and at the other end to at least one end portion of said pressure roller or to a means for support for said pressure roller, or to a movable carrier in which said pressure roller is rotatably mounted, at least one of said pressure roller or said means for support for said pressure roller, or said movable carrier being supported in said housing body.

2. The dispenser according to claim 1, wherein said housing cover is operably connected to cause movement of said pressure roller while said drive roller remains stationary.

3. The dispenser according to claim 1, wherein said drive roller is rotationally located in a drive roller carrier, said drive roller carrier being removably located within said housing body, and wherein said drive roller is operably engaged with a drive motor for rotation of said drive roller.

4. The dispenser according to claim 1, wherein at least over part of a range of movement of said pressure roller away from said drive roller during opening of said housing cover, said pressure roller is biased towards said drive roller.

5. The dispenser according to claim 1, wherein said housing cover is openable about a pivot location fixedly located with respect to said housing body.

6. The dispenser according to claim 1, wherein said housing body contains a switch or sensor operable by said housing cover when said housing cover is moved from an open position to a closed position and vice versa, said switch or sensor being operably connected with said driver roller so as to cause rotation of said driver roller by a predetermined amount when said housing cover is moved into a closed position.

7. The dispenser according to claim 1, wherein said housing cover can be opened to a position in which said pressure roller is moved a maximum distance away from said drive roller to a fully open nip position, said pressure roller and said drive roller being separated by a distance of at least 0.5 cm, in said fully open nip position.

8. The dispenser according to claim 1, wherein said pressure roller comprises at least a metallic outer surface.

9. The dispenser according to claim 1, wherein said dispenser is a sheet material dispenser, and wherein said dispenser contains mountings for a supply of sheet material on a supply roll.

10. The dispenser according to claim 1, wherein the linkage is rotatable in a direction toward the drive roller.

11. A dispenser, comprising:

a housing body;

a housing cover; and a feed mechanism comprising a drive roller and a pressure roller, wherein said drive roller and said pressure roller form a nip therebetween, said housing cover is movable with respect to said housing body for opening and closing said housing cover, said housing cover is operably connected to at least one of said pressure roller or said drive roller such that movement of said housing cover from a closed position towards an open position moves said pressure roller relatively away from said drive roller to thereby open said nip, said housing cover has a guide surface thereon projecting inwardly from said housing cover towards an interior of said housing body, said guide surface being slidably movable against a further surface, said further surface is arranged on a movable element, and said movable element, in at least one position thereof, is operably connected to said pressure roller such that movement of said housing cover towards a closed position causes sliding engagement of said guide surface with said further surface to thereby cause said pressure roller to move closer to said drive roller, at least during part of the movement of said housing cover towards its closed position.

12. The dispenser according to claim 11, wherein said guide surface is slidably movable against said further surface during only a portion of the movement of the housing cover between a closed position and a fully open position and vice versa.

13. The dispenser according to claim 11, wherein said pressure roller is operably connected to said movable element such that movement of the movable element varies the distance of said pressure roller from said drive roller, at least over part of a range of movement of said movable element.

14. The dispenser according to claim 11, wherein said further surface is a projecting lug.

15. A method of loading a dispenser comprising a housing body, a housing cover and a feed mechanism, said feed mechanism comprising a drive roller and a pressure roller, said drive roller and said pressure roller forming a nip therebetween and wherein said housing cover is movable with respect to said housing body for opening and closing said housing cover, the method comprising:

opening the housing cover to allow access to a supply of sheet material to be used in the dispenser located in a supply storage location thereof;

inserting a leading edge portion of said sheet material between the rollers in an open condition of said nip, in which open condition said drive roller and said pressure roller have been moved relatively away from each other by a distance equal to at least twice the thickness of said sheet material; and inserting said leading edge portion into said nip, without rotation of said drive roller or said pressure roller being required, wherein said pressure roller is moved relatively away from said drive roller to open said nip by means of a rotatable operative connection between said housing cover and at least one of said pressure roller or said drive roller, and wherein said nip is closable by said rotatable operative connection, movement of said housing cover from a closed position towards an open position moves said pressure roller relatively away from said drive roller, and the nip is closed so as to clamp sheet material in the nip.

16. The method according to claim 15, wherein after inserting said leading edge into said nip in its open condition, said nip is then closed into pressure contact with said sheet material.

17. The method according to claim 15, wherein opening of the housing cover, during part of its movement, causes movement of at least one of the pressure roller or the drive roller so that the nip between pressure roller and drive roller is opened, and vice versa whereby closure of the housing cover causes said pressure roller and drive roller to move together.

18. The method according to claim 17, wherein opening of the housing cover, during another part of its movement, does not cause movement of at least one of the pressure roller or the drive roller, and vice versa whereby closure of the housing cover during said another part of its movement, does not cause movement of at least one of the pressure roller or the drive roller.

19. The method according to claim 15, in which a supply of sheet material is inserted into said dispenser into a supply storage location and a leading edge of said sheet material is pulled by hand to a location in which said leading edge is located between said drive roller and said pressure roller.

20. The method according to claim 15, wherein the operative connection is rotatable in a direction toward the drive roller.

* * * * *